US009062567B2

(12) United States Patent
Kaji

(10) Patent No.: US 9,062,567 B2
(45) Date of Patent: Jun. 23, 2015

(54) FAN

(71) Applicant: Nidec Corporation, Kyoto (JP)

(72) Inventor: Yasuyuki Kaji, Kyoto (JP)

(73) Assignee: Nidec Corporation, Kyoto (JP)

( * ) Notice: Subject to any disclaimer, the term of this patent is extended or adjusted under 35 U.S.C. 154(b) by 454 days.

(21) Appl. No.: 13/676,158

(22) Filed: Nov. 14, 2012

(65) Prior Publication Data

US 2013/0156573 A1 Jun. 20, 2013

(30) Foreign Application Priority Data

Dec. 19, 2011 (JP) ..... 2011-277022

(51) Int. Cl.
*F01D 25/16* (2006.01)
*F04D 25/06* (2006.01)
*F04D 29/02* (2006.01)

(52) U.S. Cl.
CPC ..... *F01D 25/162* (2013.01); *F04D 25/062* (2013.01); *F04D 29/023* (2013.01)

(58) Field of Classification Search
CPC . F04D 19/002; F04D 25/0613; F04D 25/062; F04D 25/0646; F04D 29/023; F04D 29/053; F04D 29/056
See application file for complete search history.

(56) References Cited

U.S. PATENT DOCUMENTS

| | | | | |
|---|---|---|---|---|
| 3,614,261 | A * | 10/1971 | Friese | 416/174 |
| 6,720,694 | B2 * | 4/2004 | Horng et al. | 310/90 |
| 6,847,141 | B2 * | 1/2005 | Wang | 310/91 |
| 7,267,528 | B2 * | 9/2007 | Hsu et al. | 415/229 |
| 7,510,331 | B2 * | 3/2009 | Hong et al. | 384/243 |
| 7,922,447 | B2 * | 4/2011 | Kao | 415/229 |
| 8,142,159 | B2 * | 3/2012 | Chang et al. | 416/174 |

FOREIGN PATENT DOCUMENTS

JP 2010-124647 A 6/2010

* cited by examiner

*Primary Examiner* — Igor Kershteyn
(74) *Attorney, Agent, or Firm* — Keating & Bennett, LLP

(57) ABSTRACT

A fan includes a stationary portion, a rotating portion, and a plurality of blades. The stationary portion includes a stator, an integral one-piece molded metal bearing housing, a bearing portion in the bearing housing, and a molded resin base portion supporting the bearing housing. The rotating portion includes a rotor holder, a rotor magnet, and a shaft. The bearing housing includes a cylindrical portion, and a protruding portion extending radially outwards from a lower portion of the cylindrical portion. The cylindrical portion includes a groove portion extending in an axial direction and arranged in a circumferential direction. The groove portion is joined to a region on the lower side of the protruding portion along a connecting position between the cylindrical and protruding portions. A resin on an upper side of the protruding portion, a resin on a lower side, and a resin in the groove portion are continuous.

7 Claims, 14 Drawing Sheets

FAN

BACKGROUND OF THE INVENTION

1. Field of the Invention

The present invention relates to an electrically operated fan.

2. Description of the Related Art

A fan disclosed in Japanese Laid-Open Patent Publication No. 2010-124647 includes a bearing housing, an annular plate, and a resin layer. The bearing housing is formed of metal. On an outer circumferential surface of the bearing housing, an uneven portion is formed by knurling. The annular plate is made of metal. The annular plate is press-fitted to the bearing housing. A base portion is formed by covering the surface of the annular plate with a resin layer.

The fan disclosed in Japanese Laid-Open Patent Publication No. 2010-124647 can reduce vibrations by means of the bearing housing and the annular plate. However, in the resin of the base portion, metal portions are present over a wide range. In addition, the bearing housing and the annular plate are separate members. Accordingly, it is difficult to improve the fastening strength between the resin and the bearing housing. There are some countermeasures such as increasing the thickness of the resin layer or molding the bearing housing and the base portion from metal, but such countermeasures result in an increased cost.

SUMMARY OF THE INVENTION

Preferred embodiments of the present invention provide a fan which includes: a stationary portion; a rotating portion rotatably supported by the stationary portion; and a plurality of blades arranged on an outer circumference of the rotating portion to generate a flow of air by the rotation of the rotating portion. The stationary portion includes: a stator; a bearing housing arranged on the inside of the stator and defined by a molded one-piece integral metal member; a bearing portion arranged in the bearing housing; and a base portion made of molded resin and arranged to support the bearing housing. The rotating portion includes: a rotor holder having a substantially cylindrical shape with a cover; a rotor magnet arranged on a radially outer side of the stator and on an inner side of an inner circumferential surface of the rotor holder; and a shaft connected to the cover of the rotor holder and inserted into the bearing portion. The bearing housing includes: a cylindrical portion; and a protruding portion expanding radially outwards from a lower portion of the cylindrical portion, the cylindrical portion includes, on an outer circumferential surface, at least one groove portion extending in an axial direction and arranged in a circumferential direction, and the at least one groove portion is joined to a region on the lower side of the protruding portion along the side of a connecting position between the cylindrical portion and the protruding portion such that a resin positioned on an upper side of the protruding portion as a portion of the base portion, a resin positioned on a lower side, and a resin arranged in the at least one groove portion are continuous.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Referring to FIGS. 1 through 14, preferred embodiments of the present invention will be described in detail. In the following description, the upper side of FIG. 1 in the direction along the center axis J1 of a fan is simply referred to as "the upper side", and the lower side thereof is simply referred to as "the lower side". It should be noted that in the explanation of preferred embodiments of the present invention, up/down directions do not indicate positional relationships among and orientations of components assembled in an actual device. Meanwhile, a direction parallel or substantially parallel to the center axis J1 is simply referred to as "an axial direction", a direction perpendicular or substantially perpendicular to the center axis J1 is simply referred to as "a radial direction", and a circumferential direction with the center axis J1 as the center is simply referred to as "a circumferential direction".

Figure 1:
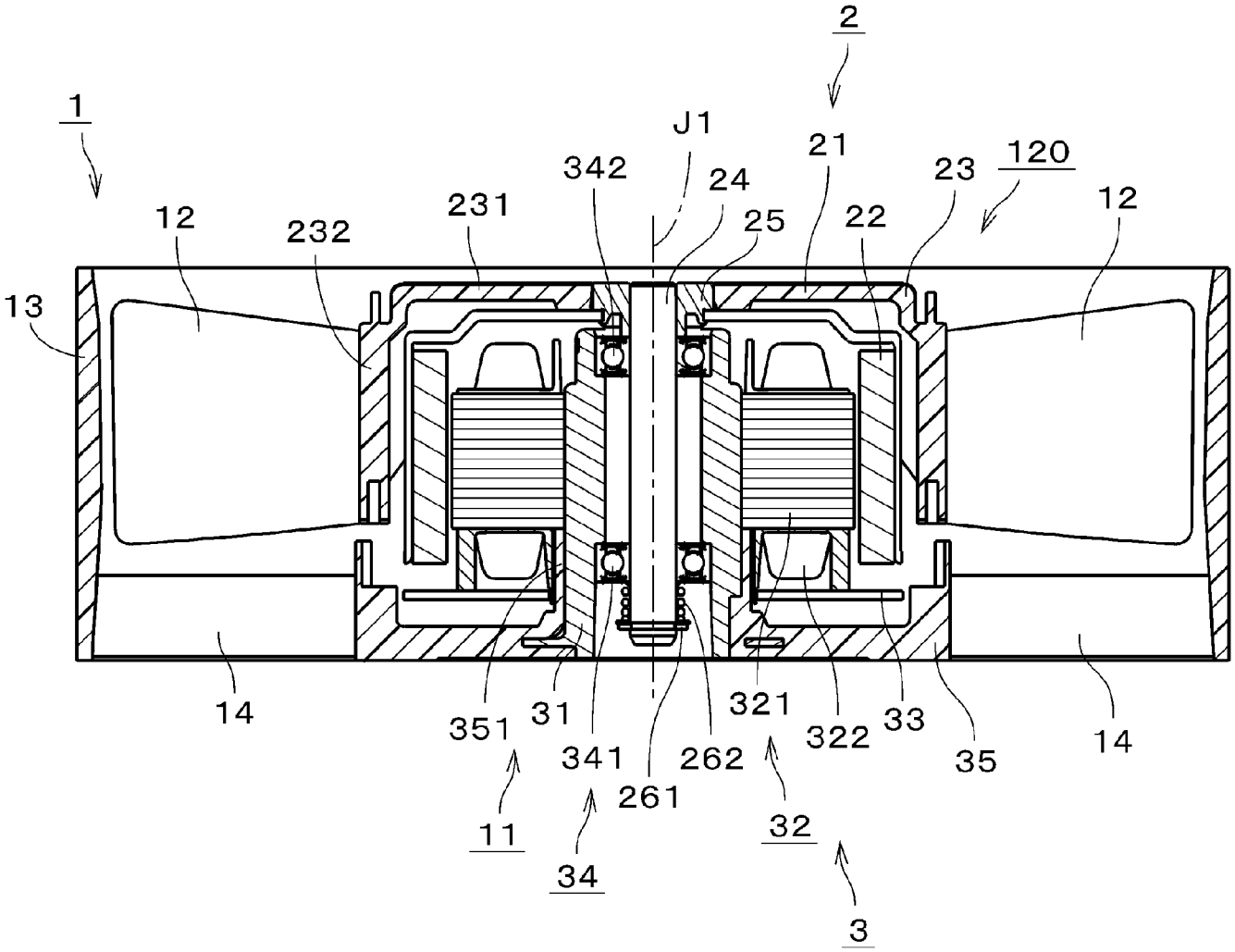
FIG. 1 is a longitudinal sectional view of a fan according to a preferred embodiment of the present invention.

FIG. 1 is a longitudinal sectional view of a fan 1 according to a preferred embodiment of the present invention. The fan 1 preferably is an axial flow fan. The fan 1 preferably includes a motor 11, a plurality of blades 12, a housing 13, and a plurality of supporting ribs 14. The housing 13 surrounds the outer circumference of the motor 11 and the plurality of blades 12. The housing 13 is preferably connected to the motor 11 via the supporting ribs 14. The plurality of supporting ribs 14 are arranged in the circumferential direction.

The motor 11 is preferably a three-phase motor of outer rotor type; however, any other desirable type of motor could be used. The motor 11 includes a rotating portion 2 and a stationary portion 3. The rotating portion 2 is supported by the stationary portion 3 in a rotatable manner with the center axis J1 as the center. The rotating portion 2 preferably includes a rotor holder 21, a rotor magnet 22, a cup 23, a shaft 24, and a bushing 25. The rotor holder 21 and the cup 23 have a cylindrical shape with a cover. The rotor holder 21 is arranged on the inside of the cup 23. The rotor magnet 22 is arranged on the inner side of the inner circumference of the rotor holder 21. The rotor magnet 22 may be directly fixed onto the inner circumferential surface of the rotor holder 21. Alternatively, the rotor magnet 22 may be fixed on the inner circumferential surface of the rotor holder 21 via any other member. The bushing 25 is preferably made of metal. The bushing 25 is fixed to a top portion of the shaft 24. The shaft 24 is indirectly fixed to the rotor holder 21 via the bushing 25. Alternatively, the bushing 25 could be left out such that the shaft 24 would be directly fixed to the rotor holder 21.

The cup 23 and the plurality of blades 12 are preferably formed by, for example, injection molding of a resin. The cup 23 and the plurality of blades 12 preferably define an integral one-piece monolithic member. The plurality of blades 12 are arranged on the outer circumference of the rotating portion 2. In the fan 1, the plurality of blades 12 are rotated around the center axis J1 by the rotating portion 2, so that downward airflow occurs from the top. An impeller 120 is defined by the cup 23 and the plurality of blades 12. The cup 23 preferably includes a cover portion 231 and a side-wall portion 232. The cover portion 231 preferably extends perpendicularly or substantially perpendicularly to the center axis J1. The top portion of the shaft 24 is indirectly fixed to the cover potion 231. The side-wall portion 232 extends downwards from an outer peripheral portion of the cover 231. The plurality of blades 12 extend outwards in a radial direction from an outer circumference of the side-wall portion 232 with the center axis J1 as the center.

The stationary portion 3 preferably includes a substantially cylindrical bearing housing 31, a stator 32, a circuit board 33, a bearing portion 34, and a base portion 35. The bearing housing 31 is preferably made of molded metal. The bearing housing 31 is arranged on the inside of the stator 32. The base portion 35 is preferably molded by a resin. A lower portion of the bearing housing 31 is fastened to the base portion 35 preferably by, for example, insert molding. The base portion 35 supports the bearing housing 31. The base portion 35, the supporting ribs 14, and the housing 13 are preferably molded to define an integral one-piece monolithic member through, for example, injection molding of a resin.

The stator 32 is preferably fixed to the outer circumferential surface of the bearing housing 31 on the upper side of the base portion 35. The stator 32 is positioned on the radially inner side of the rotor magnet 22. The base portion 35 preferably includes a base cylindrical portion 351 arranged to cover the lower portion of the bearing housing 31. The stator 32 is in contact with the upper end of the base cylindrical portion 351. The stator 32 includes a stator core 321 and a plurality of coils 322 provided on the stator core 321. The stator core 321 preferably includes, for example, laminated steel plates; however, any other desirable type of stator core could be provided. The circuit board 33 is fixed to the lower portion of the stator 32. The stator 32 and the circuit board 33 are electrically connected. In the driving of the motor 11, a torque is created between the rotor magnet 22 and the stator 32.

The bearing portion 34 preferably includes a lower ball bearing 341 and an upper ball bearing 341 arranged in the bearing housing 31. Both of the ball bearings 341 and 342 are inserted into the bearing housing 31. Outer rings of both of the ball bearings 341 and 342 are fixed to the inner circumferential surface of the bearing housing 31 preferably by, for example, press-fitting or adhesion. The shaft 24 is inserted through the inner rings of the both ball bearings 341 and 342. The rotating portion 2 is supported by the bearing portion 34 and the shaft 24 in the rotatable manner with respect to the stationary portion 3. A retaining ring 261 and a pre-compression spring 262 are preferably provided in the lower portion of the shaft 24. Accordingly, a pre-compression force is applied to the inner ring of the lower ball bearing 341 by the pre-compression spring 262 and a pre-compression force is applied to the inner ring of the upper ball bearing 342 by the bushing 25.

Figure 2:
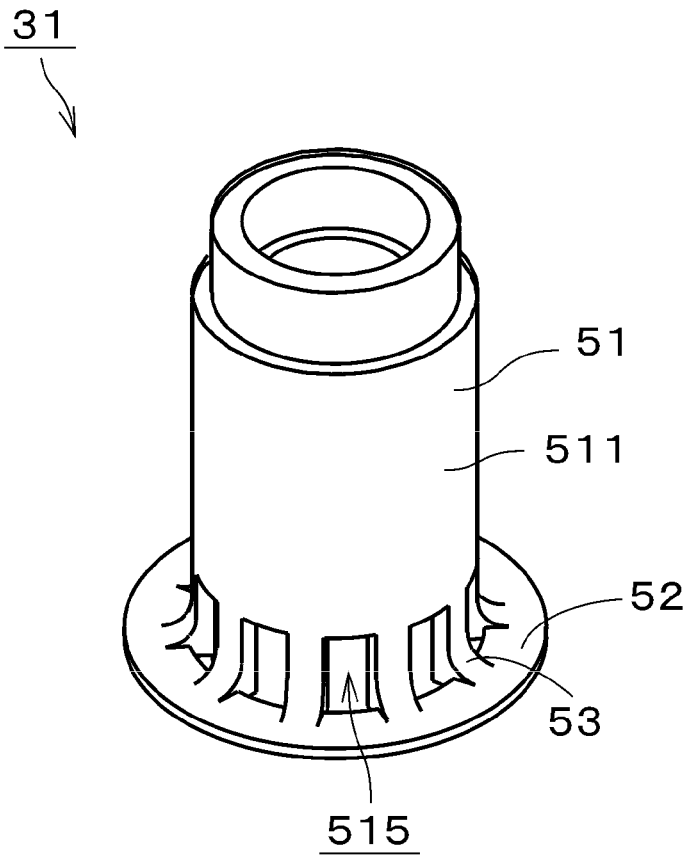
FIG. 2 is a perspective view of a bearing holder according to a preferred embodiment of the present invention.
Figure 3:
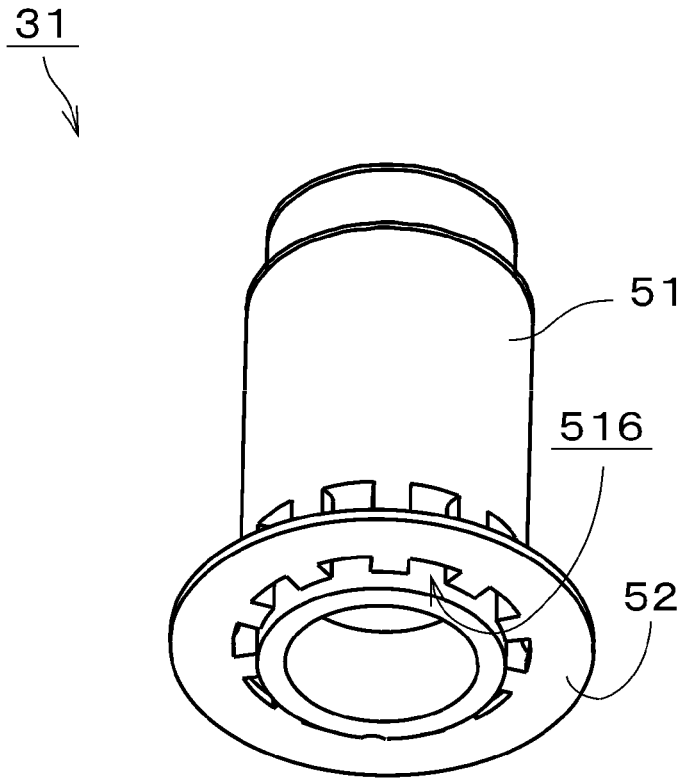
FIG. 3 is a perspective view of the bearing holder according to a preferred embodiment of the present invention.

FIG. 2 is a perspective view showing the bearing housing 31 viewed diagonally from above. FIG. 3 is a perspective view of the bearing housing 31 viewed diagonally from below. FIG. 4, FIG. 5, FIG. 6, and FIG. 7 are a front view, a top plan view, a bottom plan view, and a longitudinal sectional view of the bearing housing 31, respectively.

The bearing housing 31 preferably includes a cylindrical portion 51 extending along the center axis J1, and an annular plate portion 52. The cylindrical portion 51 is arranged on the inside of the stator 32. The plate portion 52 is a protruding portion annularly extending radially outwards from the lower portion of the cylindrical portion 51. Specifically, the plate portion 52 is connected to the cylindrical portion 51 on the slightly upper side than a lower end of the cylindrical portion 51. The lower end of the cylindrical portion 51 is positioned on the lower side of the plate portion 52. The cylindrical portion 51 and the plate portion 52 are preferably molded from metal to define an integral one-piece monolithic member. For example, the cylindrical portion 51 and the plate portion 52 are preferably formed by machining after the molding by aluminum die-casting, zinc die-casting, or the like.

Figure 4:
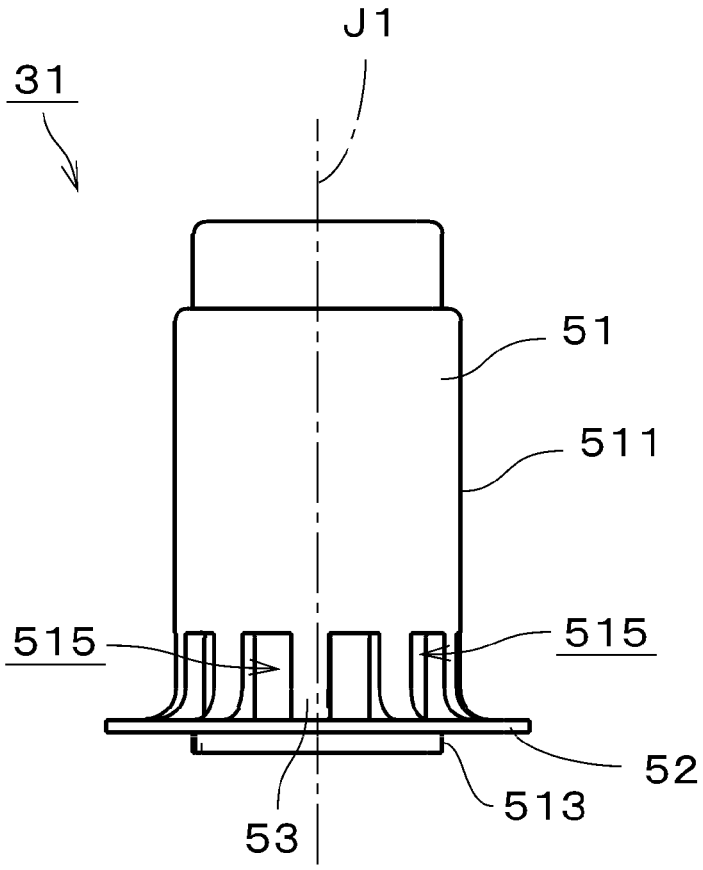
FIG. 4 is a front view of the bearing holder according to a preferred embodiment of the present invention.
Figure 5:
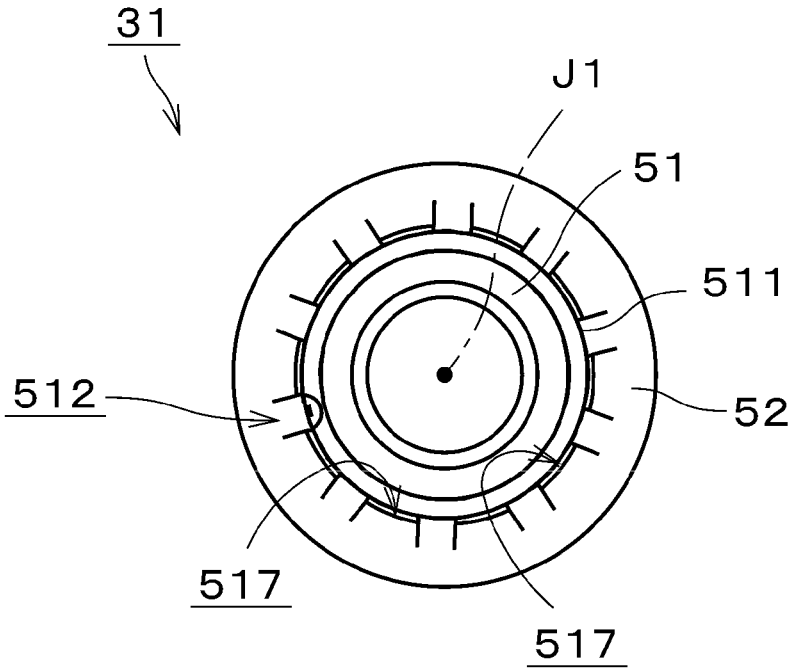
FIG. 5 is a top plan view of the bearing holder according to a preferred embodiment of the present invention.
Figure 6:
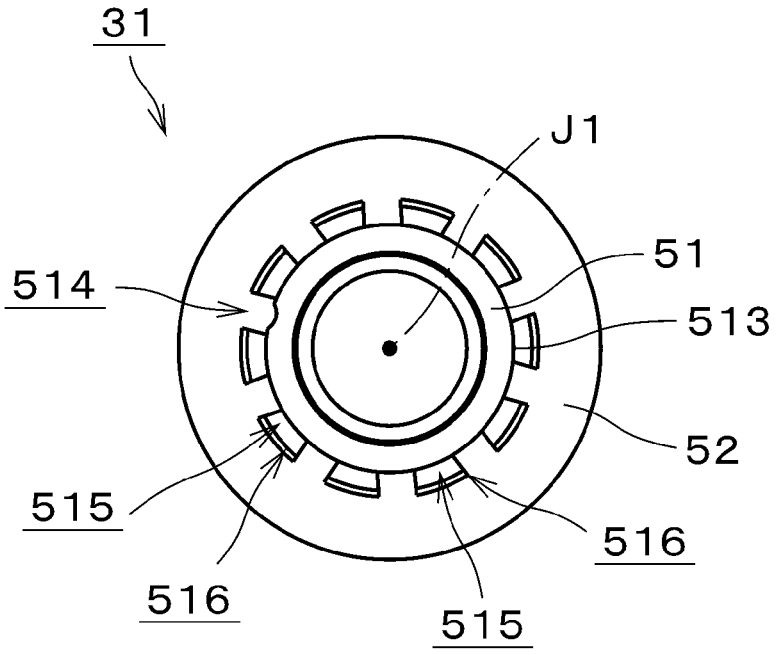
FIG. 6 is a bottom plan view of the bearing holder according to a preferred embodiment of the present invention.
Figure 7:
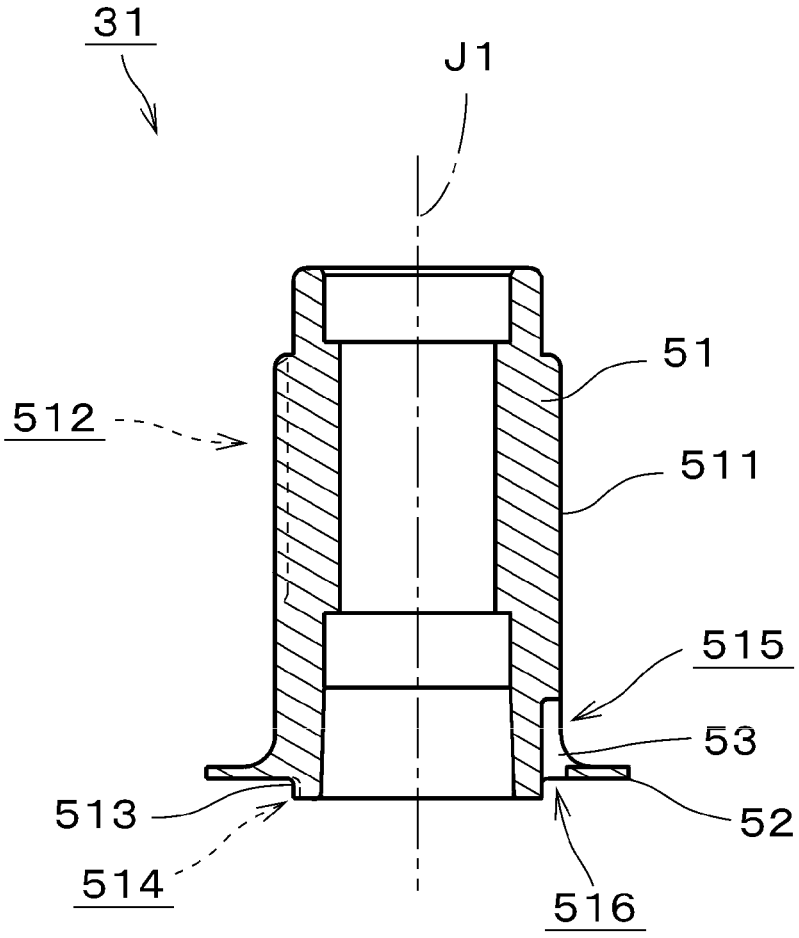
FIG. 7 is a longitudinal sectional view of the bearing holder according to a preferred embodiment of the present invention.

As shown in FIG. 5 and FIG. 7, a groove 512 extending in an axial direction is provided on an outer circumferential surface 511 of the cylindrical portion 51 on the upper side of the plate portion 52. The groove 512 is provided to aid in positioning during insert molding and to also aid in positioning in a circumferential direction when the stator 32 is attached. As shown in FIG. 6 and FIG. 7, a groove 514 is provided on an outer circumferential surface 513 of the cylindrical portion 51 on the lower side of the plate portion 52. The diameter of the outer circumferential surface 511 is preferably larger than the diameter of the outer circumferential surface 513. In FIG. 4, the grooves 512 and 514 are omitted.

As shown in FIG. 2 and FIG. 7, a plurality of groove portions 515 each extending in the axial direction are preferably provided on the outer circumferential surface 511 of the cylindrical portion 51 in such a manner that they are arranged in the circumferential direction. The plurality of groove portions 515 are provided in the vicinity of the plate portion 52. The groove portions 515 extend downwards so as to go through the plate portion 52. In other words, in the bearing housing 31, a plurality of through holes 516 which vertically go through the connecting position between the cylindrical portion 51 and the plate portion 52 are preferably provided. The plurality of through holes 516 are axially corresponding portions of the plurality of groove portions 515, respectively. A bottom surface which is a radially inner surface of the groove portion 515, a radially inner surface of the through hole 516, and the outer circumferential surface 513 in the lower portion of the cylindrical portion 51 are preferably continuous in the axial direction. In the bearing housing 31, the position between the respective through holes 516 corresponds to the connecting position between the cylindrical portion 51 and the plate portion 52. The respective groove portions 515 are joined to a region on the lower side of the plate portion 52 along the side of the connecting position.

In the plate portion 52, a radially outer portion of the through hole 516 is slightly recessed radially outwards with respect to the outer circumferential surface 511 of the cylindrical portion 51. In other words, as shown in FIG. 5, the plate portion 52 preferably includes a plurality of recessed portions 517 which are recessed radially outwards with respect to the outer circumferential surface 511 of the cylindrical portion 51 as the radially outer portions of the plurality of through holes 516. With such configuration, when the bearing housing 31 is viewed from right above, a portion of the through hole 516 can be seen. As described above, the diameter of the outer circumferential surface 511 on the upper side of the plate portion 52 is larger than the diameter of the outer circumferential surface 513 on the lower side of the plate portion 52. Accordingly, as shown in FIG. 6, when the bearing housing 31 is viewed from directly below, the through hole 516 opens wider than in the case where the bearing housing 31 is viewed from directly above.

In addition, as shown in FIG. 2, FIG. 4, and FIG. 7, the connecting portion 53 between the cylindrical portion 51 and the plate portion 52 has a so-called "R" (round) shape. That is, the connecting portion 53 including the portion between the plurality of groove portions 515 in the cylindrical portion 51, expands radially outwards in the connecting position between the cylindrical portion 51 and the plate portion 52. With such a configuration, the connection strength between the cylindrical portion 51 and the plate portion 52 can be ensured. It should be understood that the shape of the connecting portion 53 is not limited to the R shape, but the shape may be a linear slope or a step in section.

Figure 8:
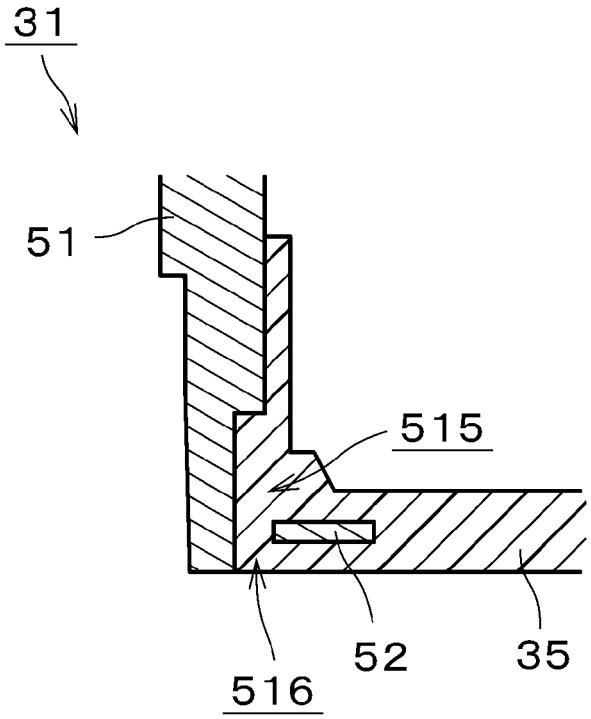
FIG. 8 is a longitudinal sectional view of a portion of the bearing holder and the base portion according to a preferred embodiment of the present invention.

FIG. 8 is a sectional view showing the vicinity of the fastening portion of the bearing housing 31 and the base portion 35. FIG. 8 shows the section in the position of the groove portion 515. A resin of a portion of the base portion 35 positioned on the upper side of the plate portion 52, a resin positioned on the lower side thereof, and a resin existing in the respective groove portion 515 are continuous. Accordingly, the fastening strength in the axial direction and in the circumferential direction of the bearing housing 31 with respect to the base portion 35 is improved. Especially in the circumferential direction, an area in which the bearing housing 31 is engaged with the base portion 35 is increased by providing the groove portions 515 such that they extend in the axial direction. The resin is preferably vertically continuous on the radially inner side of the plate portion 52. Accordingly, the fastening strength in the axial direction of the plate portion 52 is improved as compared with the case where a hole is simply provided.

The cylindrical portion 51 preferably is present even on the lower side of the plate portion 52. Accordingly, in the insert molding, the resin can be easily introduced to the lower side of the plate portion 52. As shown in FIG. 5, the recessed portion 517 is preferably arranged such that a portion of the through hole 516 can be seen when viewed from the above. Therefore, the resin can easily enter into the groove portions 515 in the injection molding. The depth of the recessed portion 517 radially outwards from the outer circumferential surface 511 may be larger than the depth of the groove portion 515 radially inwards from the outer circumferential surface 511. Due to the improvement in fastening strength between the bearing housing 31 and the base portion 35, the vibration of the fan 1 can be reduced.

By causing the groove portion 515 to be axially continuous, an undercut portion can be eliminated in the molding by die-casting, thereby simplifying the mold construction. Alternatively, the bearing housing 31 may preferably be formed, for example, by machining.

Figure 9:
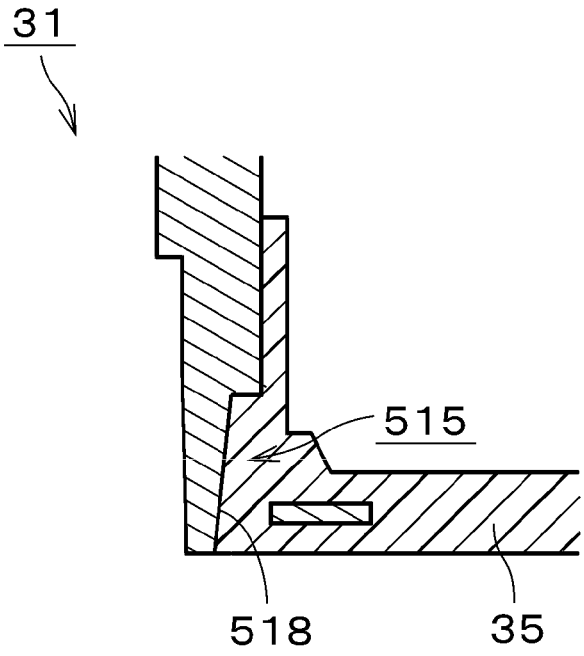
FIG. 9 is a longitudinal sectional view of a portion of the bearing holder and the base portion according to a preferred embodiment of the present invention.

FIG. 9 is a sectional view showing another example of the lower portion of the bearing housing 31 in accordance with a preferred embodiment of the present invention. FIG. 9 shows a portion of the section in the condition where the base portion 35 is provided similarly to FIG. 8. In the bearing housing 31 of FIG. 9, a bottom 518 on the radially inner side of the respective groove portion 515 is inclined radially inwards toward the lower portion. Accordingly, the molding of the bearing housing 31 can be easily performed. In addition, the filling of resin in the insert molding can be easily performed. The fastening strength between the bearing housing 31 and the base portion 35 is improved. It should be understood that the bottom 518 may not be limited to be planar, but alternatively be U-shaped or V-shaped in section, for example. Instead of the inclination, the bottom 518 may alternatively have a radially inward step toward the lower portion.

Figure 10:
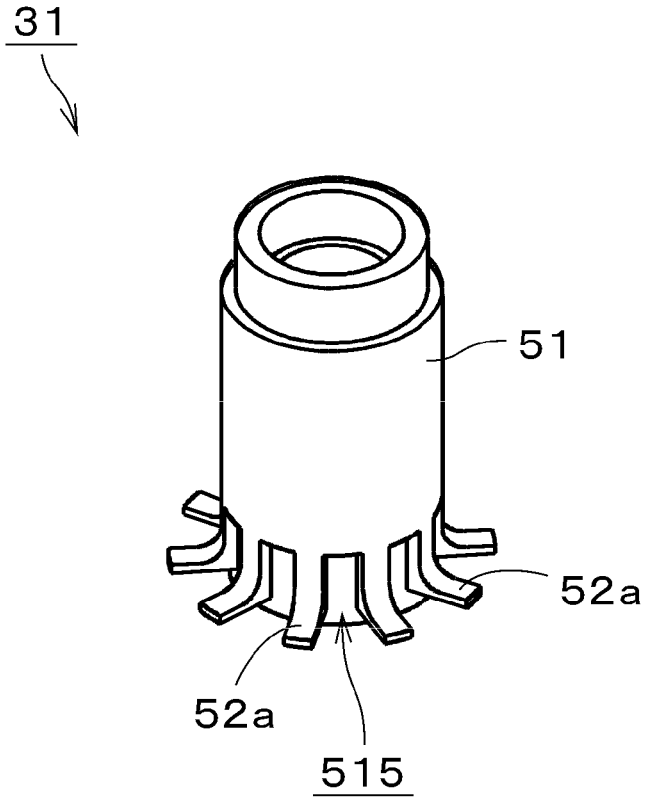
FIG. 10 is a perspective view of a bearing holder according to another preferred embodiment of the present invention.
Figure 11:
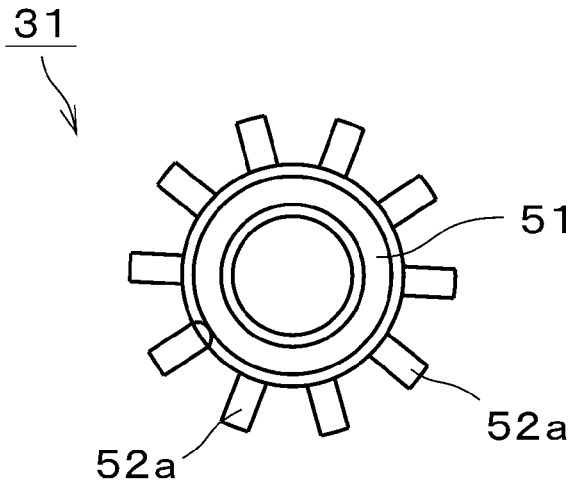
FIG. 11 is a top plan view of the bearing holder according to another preferred embodiment of the present invention.

FIG. 10 is a perspective view of a bearing housing 31 according to another preferred embodiment of the present invention. FIG. 11 is a top plan view of the bearing housing 31 shown in FIG. 10, and FIG. 12 is a bottom plan view thereof.

Figure 12:
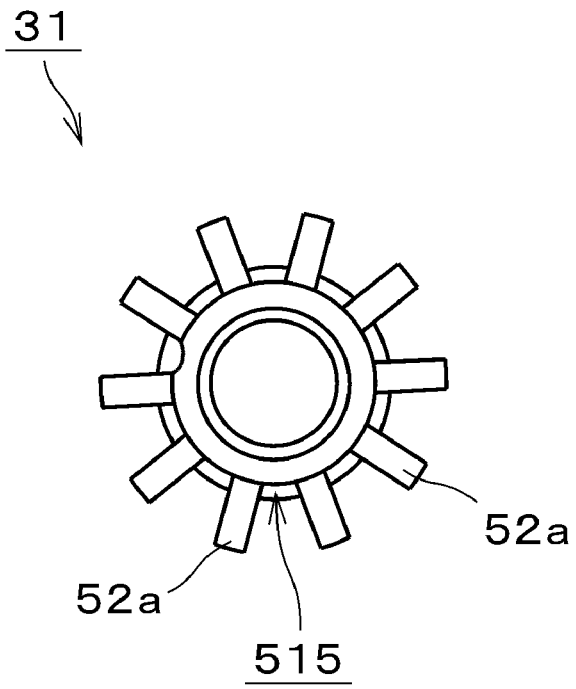
FIG. 12 is a bottom plan view of the bearing holder according to another preferred embodiment of the present invention.

In the bearing housing 31 shown in FIG. 10 to FIG. 12, instead of the plate portion 52 shown in FIG. 2, a plurality of projections 52*a* are preferably provided as projecting portions expanding radially outwards from the lower portion of the cylindrical portion 51. The other configurations are the same as those shown in FIG. 2. Respective one of the groove portions 515 is positioned between a pair of projections 52*a* which are adjacent. Also in the bearing housing 31 shown in FIG. 10 to FIG. 12, the plurality of groove portions 515 are joined to the region on the lower side of the projections 52*a* along the side of the connecting position between the cylindrical portion 51 and the projections 52*a*. In addition, a resin positioned on the upper side of the projections 52*a* as a portion of the base portion 35, a resin positioned on the lower side thereof, and a resin existing in the groove portions 515 are preferably continuous. Accordingly, the fastening strength between the bearing housing 31 and the base portion 35 is improved.

Figure 13:
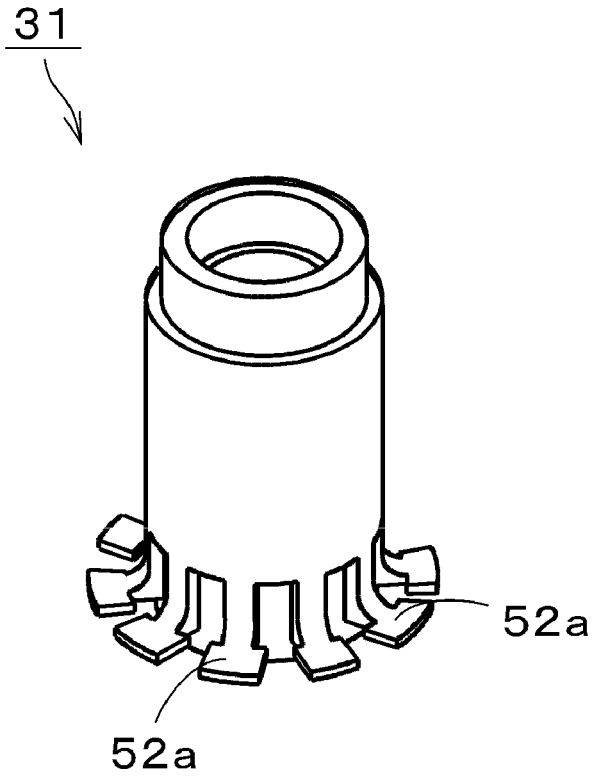
FIG. 13 is a perspective view of a bearing holder according to still another preferred embodiment of the present invention.
Figure 14:
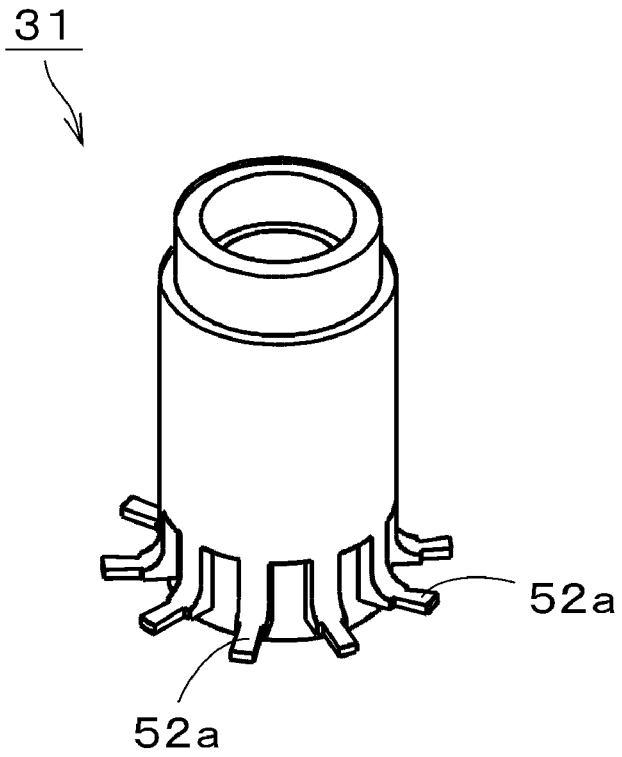
FIG. 14 is a perspective view of a bearing holder according to still another preferred embodiment of the present invention.

FIG. 13 and FIG. 14 are perspective views of a bearing housing 31 according to still other preferred embodiments of the present invention. In the bearing housing 31 shown in FIG. 13, the width in the circumferential direction of the end of the projection 52*a* shown in FIG. 10 is wider than that of the portion on the radially inner side. In the bearing housing 31 shown in FIG. 14, the width in the circumferential direction of the end of the projection 52 shown in FIG. 10 is narrower than that of the portion on the radially inner side. As shown in FIG. 10 to FIG. 14, the projecting portions expanding radially outwards from the lower portion of the cylindrical portion 51 in the bearing housing 31 may be provided in various conditions, if the groove portions 515 arranged to join the upper and lower regions of the projecting portions are provided and are annularly arranged in the circumferential direction.

Various preferred embodiments of the present invention are described above, but the present invention is not limited to those described in the above-described preferred embodiments, but may be variously modified.

For example, the bearing portion 34 may be a sleeve such as an oil-impregnated sintered bearing, or may be a bearing portion having any other structure. The bearing housing 31 may preferably be made of various kinds of metals, and more preferably made of, for example, aluminum, zinc, or brass.

The recessed portion 517 may be omitted. In such a case, the through hole 516 cannot be seen when viewed from right above. The number of groove portions 515 and the through holes 516 may be one. In other words, in the bearing housing 31, at least one groove portion 515 and the same number of through hole 516 are provided. In addition, preferably, the same number of recessed portions is provided.

The configuration of the motor 11 may be utilized as a motor for any other fan such as a centrifugal fan, or the like. The fan in which the motor 11 is utilized is most suitable for equipment on which a hard-disk device is mounted such as a server. In the server, the fan is mounted in a position near the hard-disk device. Accordingly, if a fan with large vibration is mounted, read/write errors may easily occur in the hard-disk drive. When a fan utilizing the motor 11 with small vibration is mounted on the server, it is difficult to cause read/write error to occur in the hard-disk device.

The configurations in the above-described preferred embodiments and respective modifications may be appropriately combined unless they are contradictory to each other.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A fan comprising:

a stationary portion;

a rotating portion rotatably supported by the stationary portion; and a plurality of blades arranged on an outer circumference of the rotating portion to generate a flow of air by rotation of the rotating portion; wherein the stationary portion includes:

a stator;

a bearing housing arranged on an inside of the stator, and defined by a molded metal integral one-piece member;

a bearing portion arranged in the bearing housing; and a base portion made of molded resin and arranged to support the bearing housing;

the rotating portion includes:

a rotor holder having a cylindrical or substantially cylindrical shape with a cover;

a rotor magnet arranged on a radially outer side of the stator and on an inner side of an inner circumferential surface of the rotor holder; and a shaft connected to the cover of the rotor holder and inserted into the bearing portion;

the bearing housing includes:

a cylindrical portion; and a protruding portion expanding radially outwards from a lower portion of the cylindrical portion;

the cylindrical portion includes, on an outer circumferential surface, at least one groove portion extending in an axial direction and arranged in a circumferential direction; and the at least one groove portion is joined to a region on a lower side of the protruding portion along a side of a connecting position between the cylindrical portion and the protruding portion such that a resin positioned on an upper side of the protruding portion as a portion of the base portion, a resin positioned on a lower side, and a resin existing in the at least one groove portion are all continuously provided with one another.

2. A fan according to claim 1, wherein the at least one groove portion includes a plurality of groove portions.

3. A fan according to claim 2, wherein a portion between the plurality of groove portions expands radially outwards in a connecting portion that connects the cylindrical portion and the protruding portion.

4. A fan according to claim 1, wherein a lower end of the cylindrical portion is positioned on the lower side of the protruding portion.

5. A fan according to claim 1, wherein a bottom of the at least one groove portion is inclined radially inwards toward the lower portion.

6. A fan according to claim 1, wherein the protruding portion includes a plate portion annularly extending radially outwards from the lower portion of the cylindrical portion; and a portion of the at least one groove portion in the axial direction includes at least one through hole provided through the plate portion.

7. A fan according to claim 6, wherein the plate portion includes at least one recessed portion which is recessed radially outwards with respect to the outer circumferential surface of the cylindrical portion as a radially outside portion of the at least one through hole.

* * * * *